US006264390B1

(12) United States Patent
Lee et al.

(10) Patent No.: US 6,264,390 B1
(45) Date of Patent: Jul. 24, 2001

(54) METHOD AND APPARATUS FOR REMOVING EXCESS APPLIQUE FROM AN APPLICATOR

(75) Inventors: Jennifer Paulson Lee, 96 Holland Ave., Second Floor, North White Plains, NY (US) 10603; George D. Utley, III, Ridgefield, CT (US)

(73) Assignee: Jennifer Paulson Lee, White Plains, NY (US)

( * ) Notice: Subject to any disclaimer, the term of this patent is extended or adjusted under 35 U.S.C. 154(b) by 0 days.

(21) Appl. No.: 09/214,195

(22) PCT Filed: Jul. 1, 1997

(86) PCT No.: PCT/US97/11312

§ 371 Date: Mar. 2, 1999

§ 102(e) Date: Mar. 2, 1999

(87) PCT Pub. No.: WO98/00045

PCT Pub. Date: Jan. 8, 1998

Related U.S. Application Data

(60) Provisional application No. 60/021,103, filed on Jul. 1, 1996.

(51) Int. Cl.[7] ..... A46B 11/00
(52) U.S. Cl. ..... 401/122; 401/121
(58) Field of Search ..... 401/122, 121, 401/126, 127, 129, 118

(56) References Cited

U.S. PATENT DOCUMENTS

| | | | |
|---|---|---|---|
| 140,228 | 6/1873 | Wentworth . | |
| 172,593 | 1/1876 | Waite . | |
| D. 197,107 | 12/1963 | Forgue . | |
| D. 307,545 | 5/1990 | Hibbert . | |
| D. 327,216 | 6/1992 | Connell . | |
| D. 361,404 | 8/1995 | Haas . | |
| 683,410 | 9/1901 | Mussinan . | |
| 1,146,522 | 7/1915 | Robert . | |
| 2,248,011 | 7/1941 | Neuschaefer . | |
| 2,921,330 | 1/1960 | Prytikin . | |
| 4,194,848 | 3/1980 | Kingsford . | |
| 4,332,494 | 6/1982 | Kingsford . | |
| 4,407,311 | 10/1983 | Gueret . | |
| 4,609,300 | 9/1986 | Robert . | |
| 4,705,053 | 11/1987 | Goncalves . | |
| 5,037,226 * | 8/1991 | Davis et al. | 401/122 |
| 5,096,319 | 3/1992 | Gueret . | |
| 5,102,250 | 4/1992 | Gueret . | |
| 5,397,193 | 3/1995 | Kirk, III et al. . | |

FOREIGN PATENT DOCUMENTS

| | | |
|---|---|---|
| 2722232 | 11/1978 | (DE) . |
| 0002301 | 6/1979 | (EP) . |
| 765719 | 6/1934 | (FR) . |
| 2470066 | 5/1981 | (FR) . |

OTHER PUBLICATIONS

English language abstract of DE 2,722,232—Nov. 1978.

* cited by examiner

*Primary Examiner*—David J. Walczak
(74) *Attorney, Agent, or Firm*—Morgan & Finnegan, LLP

(57) ABSTRACT

A method for removing an excess amount of applique from an applicator including the steps of applying a force to a flexible structure, and pulling the applicator through the flexible structure to engage the applicator with the flexible structure. The device for removing excess applique has a flexible segment which is manually squeezable by the user to engage the flexible segment with the applicator to remove excess applique from the applicator upon passing the applicator through the flexible segment. In one embodiment, the flexible segment includes at least one projection extending from an aperture wall which engages the applicator as the applicator is pulled through the deformed aperture in the flexible segment. In a preferred embodiment, the applique is mascara and the applicator is a mascara brush.

27 Claims, 5 Drawing Sheets

METHOD AND APPARATUS FOR REMOVING EXCESS APPLIQUE FROM AN APPLICATOR

This appln claims benefit of provisional appln 60/021,103 filed Jul. 1, 1996 which is a 371 of PCT/US97/11312 filed Jul. 1, 1997.

BACKGROUND OF THE INVENTION

1. Field of the Invention

The present invention is directed generally to a cosmetic application system and method, and more particularly to a system and method for removing excess mascara from a mascara brush upon withdrawal from a container.

2. Description of the Related Art

Various techniques and structures have been used to reduce the amount of mascara on a mascara brush upon removal from a container. However, a number of disadvantages associated with these techniques and structures has inhibited their widespread use and manufacture.

In particular, U.S. Pat. Nos. 4,194,848, 4,332,494, 4,407,311, 4,609,300 and 4,705,053 are directed to mascara applicators having a complex structure for varying the amount of mascara remaining on a brush after removal from a container. A flexible member is disposed in the neck of the container to provide some degree of variation in the amount of mascara removed from a brush as it passes through an opening in the container. However, each of these patents is directed to a complex structure, which is difficult and costly to manufacture. Moreover, many of these structures do not facilitate continuous variation of the amount of mascara to be removed from a brush. In addition, because these structures apply an equal force against the brush during removal and re-insertion of the brush into the container, these systems unnecessarily impede a user's ability to reinsert the brush into the container after each use. In U.S. Pat. No. 5,397,193, an additional attempt was made to provide a system for removing excess mascara from an applicator brush. In this system, a plurality of internal flexible bristles are used to remove excess mascara from the applicator brush. As with the aforementioned patents, this system is also costly and difficult to manufacture, and does not facilitate continuous variation in the amount of force to be applied to the mascara brush upon removal from its container. In addition, this system also unnecessarily impedes a user's ability to reinsert the brush into the container after each use.

In addition, each of the aforementioned systems, because of their complicated internal structure, is particularly difficult to clean. Accordingly, these go systems do not lend themselves for use with any form of reusable or interchangeable mascara system.

OBJECTS OF THE INVENTION

Accordingly, it is an object of the present invention to provide a comprehensive mascara system which is both cost-effective in use and manufacture.

It is a further object of the present invention to provide a simple and attractive system for removing excess applique, such as cosmetic, from an applicator, such as a brush, upon removal of the applicator from a container.

It is a further object of the present invention to provide such a system for removing excess mascara which is continuously variable by a user, thereby allowing the user to specifically determine the amount of mascara for removal from the brush.

It is a further object of the present invention to provide such a system for removing excess cosmetic from a brush, which does not impede a user's ability to reinsert the brush into a container.

It is a further object of the present invention to provide a system for removing excess cosmetic from a brush which is easily cleanable and lends itself for use with an interchangeable cartridge system.

It is a further object of the present invention to provide a cosmetic containment system having interchangeable cartridges to facilitate use of various forms of cosmetic.

Other objects and features of the present invention will become more readily apparent upon a review of the following detailed description of the preferred embodiments of the present invention, in conjunction with the accompanying drawings and the appended claims.

SUMMARY OF THE INVENTION

According to a method of one embodiment of the present invention, an excess amount of cosmetic material is removed from a brush including the steps of applying a force to a deformable structure having projections therewithin, and pulling the brush through the deformable structure to engage the brush with the projections. The method may further include the steps of releasing said deformable structure and pushing the brush back through the deformable structure so that the brush passes therethrough with less interference from said projections than the step of pulling the brush through the deformable structure.

In accordance with one embodiment of the present invention, an apparatus for removing excess applique from an applicator is disclosed. The apparatus includes a flexible segment having a first end, a second end, and an aperture passing through the flexible segment from the first end to the second end. The aperture has a wall and is dimensioned to receive the applicator. Furthermore, the flexible segment is manually squeezable so as to engage the applicator, thereby removing excess applique therefrom.

DETAILED DESCRIPTION OF THE PREFERRED EMBODIMENTS OF THE PRESENT INVENTION

Figure 1:
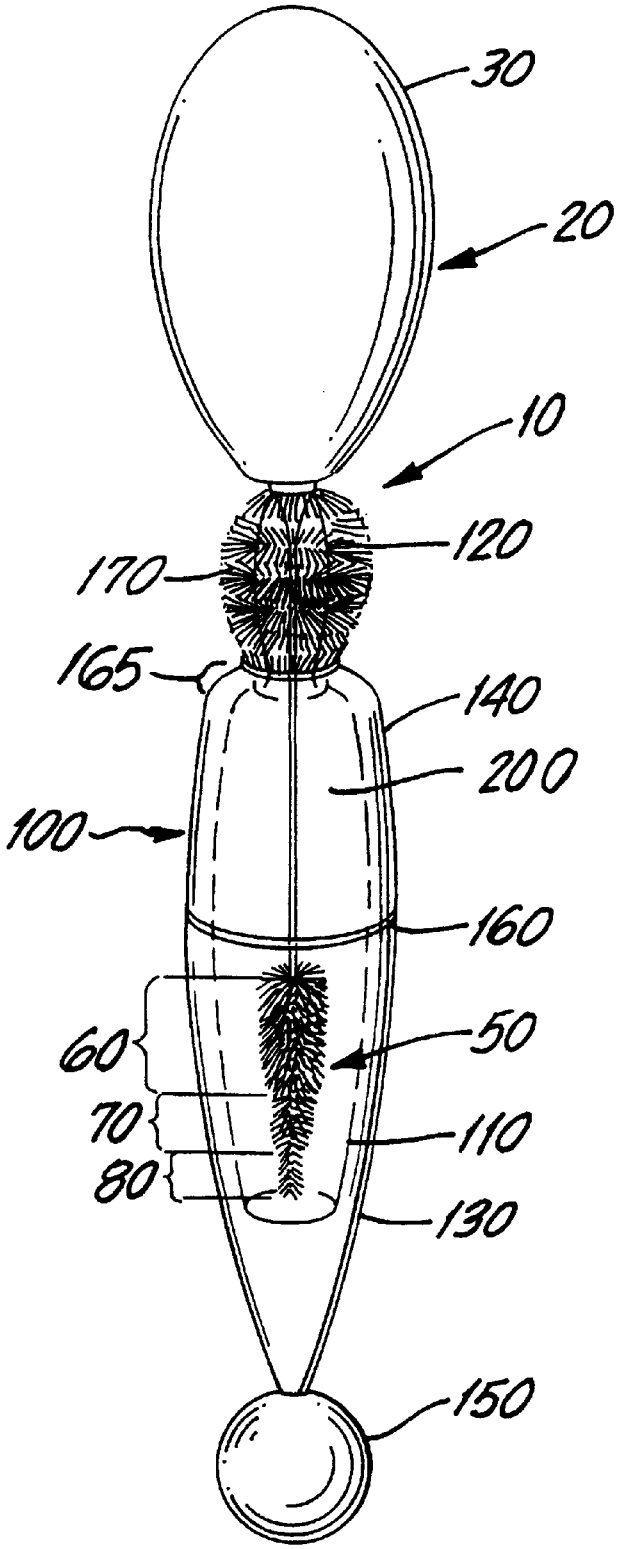
FIG. 1 is a diagram illustrating one embodiment of the cosmetic applicator of the present invention.

With reference to the drawings, several embodiments of the present invention will now be described. With reference to FIG. 1, a cosmetic applicator 10 is shown. Cosmetic applicator 10 comprises generally (1) a cosmetic brush and handle 20, (2) a housing 100 having a flexible segment 120, and (3) a replaceable cartridge 200, each of which will now be described in greater detail below.

Figure 2:
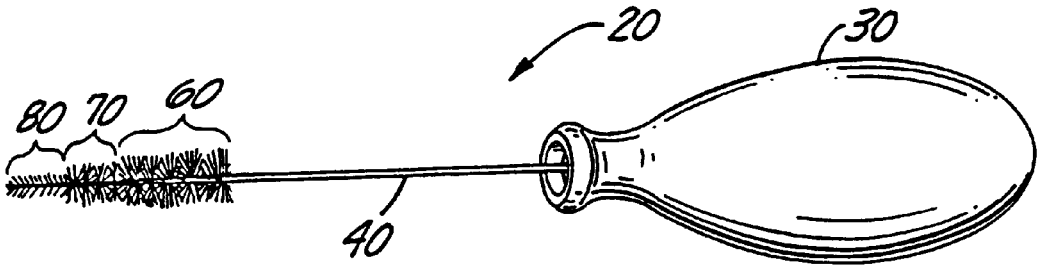
FIG. 2 depicts a cosmetic brush and handle of the present invention depicted in FIG. 1.

With continuing reference to FIG. 1, and with particular reference to FIG. 2, a cosmetic brush and handle 20 is shown. Handle 30 preferably has an enlarged rubber ergonomic grip to facilitate a user's manipulation of the cosmetic brush. Although a rubber material is disclosed in the preferred embodiments of the present invention, it is to be understood that other types of materials which facilitate gripping by the user may also be utilized. A rod 40 is attached to the rubber grip 30. A brush 50 is disposed at the end of rod 40. The brush 50 is divided into 3 sections. A first portion 60 contains a series of graduated spiral bristles which is useful for tight areas in mascara application. The second portion 70 includes graduated bristles which are larger and less spiralled than the bristles of the first portion 60. The third portion 80 contains a plurality of non-spiralled bristles which are larger than the bristles of the first and second portions, and which preferably are all of the same length. This third bristle portion 80 is used to apply the majority of the mascara to an eyelash.

With continuing reference to FIG. 1, a housing 100 containing a replaceable cartridge 200, a flexible segment 120, a bottom portion 130, and an intermediate portion 140, is disclosed. The use of a replaceable cartridge system 200, which is contained within a hollow cosmetic-containing portion 110 created by bottom portion 130 and intermediate portion 140, facilitates interchangeability of various cartridges 200 within housing 100, thereby allowing use of the structure of the present invention with a plurality of mascara or cosmetic substances.

The bottom portion 130 has a flat anti-roll end 150, disposed at the end of portion 130. Upon placing the entire cosmetic applicator 10 upon a flat or inclined surface, this flat anti-roll end 150 inhibits the cosmetic applicator from rolling away, or off, the surface. Although the flat, disk-like structure 150 is shown, it is to be understood that similar shapes may be utilized to prevent rolling of the cosmetic applicator of the present invention.

Bottom portion 130 and intermediate portion 140 may be twisted apart at juncture 160 to reveal the replaceable cartridge 200 therewithin. In the alternative, other types of connectors including a threaded, screw-type connector may also be utilized to connect bottom portion 130 to intermediate portion 140 at juncture 160. At the end of intermediate portion 140, a flexible segment 120 is connected at juncture 165, through a similar snap-type connector, screw-type connector or other appropriate form of connector. In the alternative, flexible segment 120 may be fixedly attached to intermediate portion 140, such as with an adhesive.

This flexible segment 120 is a collapsible or deformable structure, which is preferably rubber, and is lined with toothbrush-like bristles 170 in the form of elliptical webs or rings to clean the mascara brush 50 as it is pulled through the depressed flexible segment 120. In so doing, the extent of any engagement between the bristles 170 and brush 50 controls the amount of mascara remaining on brush 50. Although in-the preferred embodiment the flexible segment 120 is spherical in shape (much like a balloon), it is to be understood that other shapes may be utilized.

Figure 3:
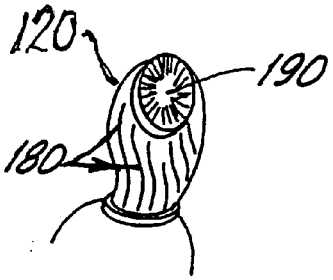
FIG. 3 depicts the open end of a flexible segment of a second embodiment of the present invention.
Figure 4:
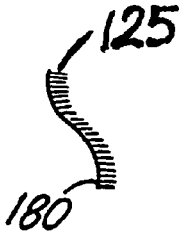
FIG. 4 depicts malleable wire and bristle arrangement in accordance with the second embodiment shown in FIG. 3.

With reference to FIG. 3, the internal structure of the flexible segment 120 in accordance with a second embodiment of the instant invention is shown. In this alternative arrangement, a series of malleable wires 180 having bristles 125 thereon is used. A malleable wire 180 is shown in isolation in FIG. 4. The use of such a wire system maintains the structural rigidity of the flexible segment 120 prior to application of any force by a user. As can be seen in FIG. 3, the bristles form a space 190 through which brush 50 may pass.

In the preferred embodiment, the flexible segment 120 is deformable from an undeformed state to a plurality of continuously variable deformed states until a deformed state is reached which prevents removal and insertion of the applicator through the flexible segment, upon application of the desired force by a user. In one embodiment of the present invention, the plurality of bristles 125, 170 within the flexible segment 120 forms a space in the flexible segment's undeformed state which is larger than the width of the cosmetic brush 50. Accordingly, if no force is applied to the flexible segment 120, the brush 50 may be reinserted into the cosmetic applicator 10 of the present invention, without interference from bristles 125 or 170. Thus, the flexible segment 120 advantageously can be structured in such a way that it does not impede the user's ability to easily insert the mascara brush into the applicator 10.

In another embodiment of the present invention, the plurality of bristles within flexible segment 120 form a space in the undeformed state which is smaller than the width of the cosmetic brush 50. If no force is applied to the flexible segment 120, the brush 50 may be reinserted into the cosmetic applicator 10 with some interference from bristles 125 or 170. However, in its undeformed state, the flexible segment 120 and the bristles therewithin provide less interference to the reinsertion of brush 50 in comparison to the amount of interference provided to movement of the brush through the flexible segment in any deformed state.

Accordingly, in use, the user may squeeze the flexible segment 120 while withdrawing the brush 50 therethrough to remove excess cosmetic from the brush 50, and then subsequently release the flexible segment 120 and reinsert the brush 50 therethrough without substantial, or any, depending on which of the aforementioned embodiments is utilized, interference from the interior of the flexible segment 120. Such an arrangement allows the user to easily reinsert the brush 50 through flexible segment 120.

In addition, should a user wish to fully clean brush 50, the user may simply rapidly insert and reinsert the brush through the flexible segment 120 and apply a force to that flexible segment 120 so that substantially all of the mascara is removed from the brush if desired.

Accordingly, the simplicity of the structure of the present invention facilitates cleaning of the system by simply separating flexible segment 120, bottom portion 130 and intermediate portion 140. After these three segments are separated, a user may readily access the internal portions of the flexible segment 120, bottom portion 130 and intermediate portion 140, to clean any debris therefrom. In addition, the modular construction of the present invention forms the basis of a reusable cosmetic applicator system which is implemented through a replaceable cartridge system.

Figure 5:
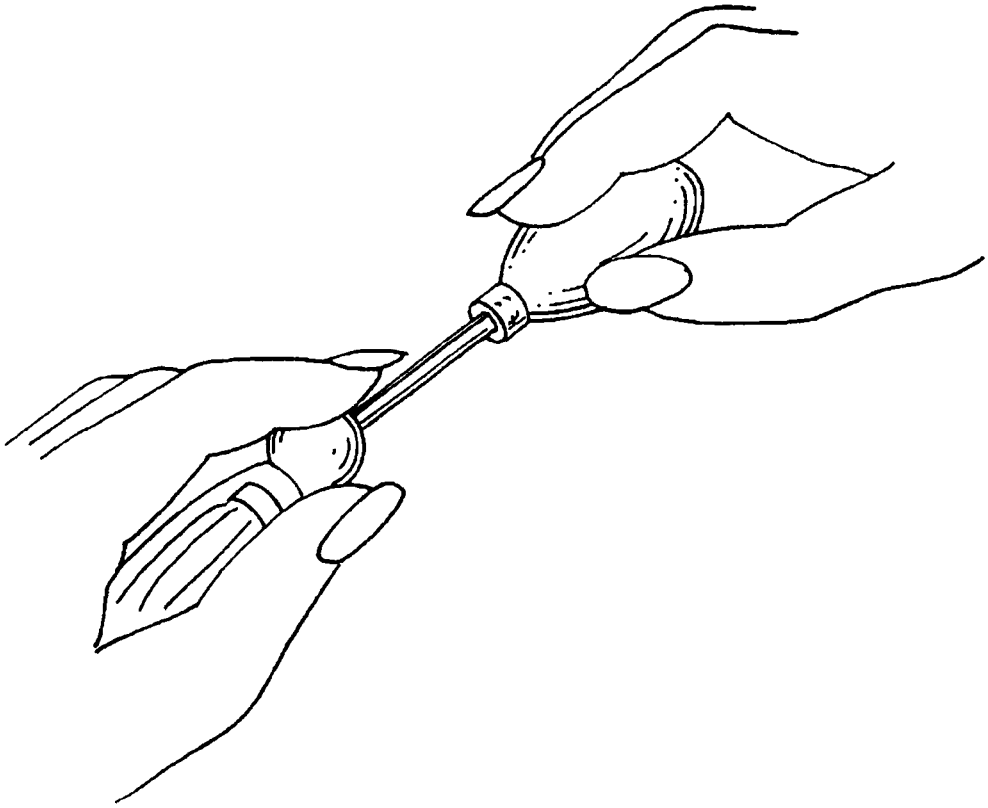
FIG. 5 depicts the cosmetic applicator of the present invention in use.

With reference to FIG. 5, the present invention is shown in use. In particular, this figure depicts an arrangement whereby a user's left hand is used to squeeze the flexible segment 120 while withdrawing or inserting the brush 50.

A flexible segment according to an alternate embodiment of the present invention will now be described with reference to FIG. 6 and continuing reference to FIG. 1. The flexible segment 300, which is shown in cross-section, has a generally barrel-shaped profile and an aperture 310 therethrough. As can be seen, the aperture 310, which receives the rod 40 and brush 50, has a generally saw-tooth-like profile. More specifically, the aperture 310 is formed by a series of concentric frusto-conical sections, one of which is designated by reference number 312.

Figure 6:
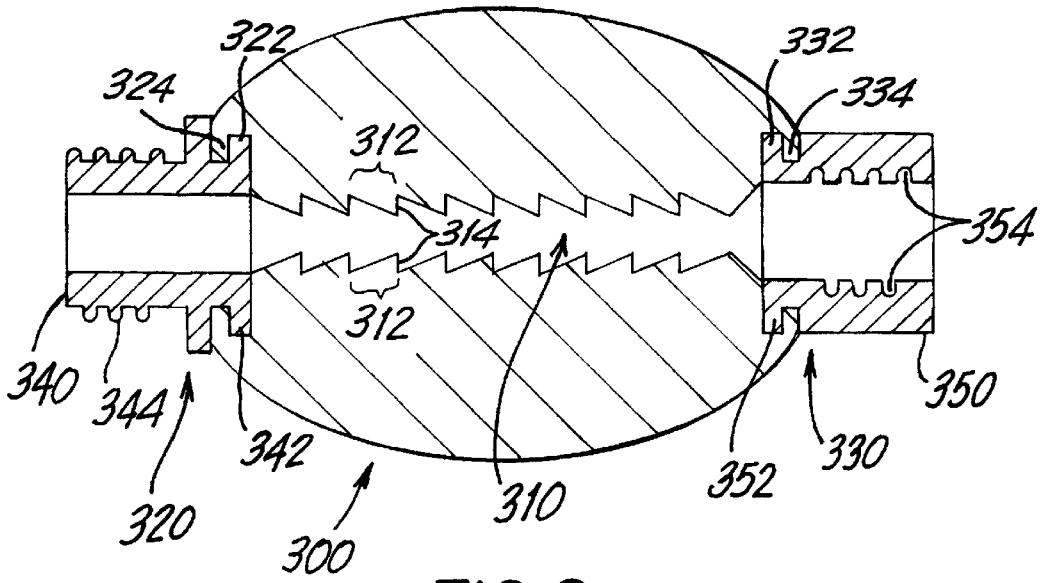
FIG. 6 depicts, in cross section, a flexible segment according to a third embodiment of the present invention.

As can be seen in FIG. 6, where each frusto-conical section 312 meets another, a projection or tooth 314 is formed. In operation, depressing or compressing the flexible segment 300 causes each tooth 314 to collapse on itself, thereby narrowing the aperture 310. As with the earlier described embodiments, the degree of depression of the flexible segment 300 while the brush 50 is pulled through the aperture 310 controls the amount of cosmetic on the brush 50. More specifically, as the brush 50 is pulled through the aperture 310, excess mascara is collected by each tooth 314. It should also be noted that when the brush 50 is re-inserted into the flexible segment 300, the brush 50 pushes the excess mascara collected by the teeth 314 back into the housing 50, thereby preventing wasted mascara.

The flexible segment 300 also includes a first end 320 and a second end 330. At each of the first 320 and second 330 ends, the flexible segment 300 includes an enlarged right-cylindrical recess 322 and 332, respectively. The flexible segment 300 further includes at each end 320, 330 a flange 324, 334.

It is to be understood that the recesses 322, 332 and the corresponding flanges 324, 334 allow for a snap-type connection between the flexible segment 300 and a male-threaded fitting 340 at the first end 320, as well as between the flexible segment 300 and a female-threaded fitting 350 at the second end 330. In order to achieve the snap-type connection, both of the threaded fittings 340, 350 include a right-cylindrical flange 342, 352, respectively having substantially the same dimensions as the recesses 322, 332 of the flexible segment 300. Thus, by engaging the flange 342, 352 of each threaded fitting 340, 350 with the recess 322, 332 of each end 320, 330, the threaded fittings 340, 350 can be secured to the flexible segment 300.

In an alternate embodiment, the threaded fittings 340, 350 are not snap-fit into the recesses 322, 332, but instead are attached to the flexible segment 300 during the molding process. Specifically, the threaded fittings 340, 350 are fabricated by any suitable means prior to fabrication of the flexible segment 300. The threaded fittings 340, 350 are then placed in the mold for the flexible segment 300, and the flexible segment 300 is formed around the existing threaded fittings 340, 350. It is to be understood that projections from the threaded fittings 340, 350, such as the flanges 342, 352, pins (not shown), and the like, prevent the fittings 340, 350 from being pulled or twisted from the flexible segment 300 when in use. Such a method of manufacture may be employed with any of the embodiments herein discussed.

The male-threaded fitting 340 is used to secure the handle 20 to the flexible segment 300. To this end, the male-threaded fitting 340 is composed of a plastic similar to that of a typical mascara housing and includes an external male thread 344 having, in the present embodiment, the same dimensions as the threads on a typical mascara housing 100. With such threads 344, a typical mascara handle 20 may be secured to the male-threaded fitting 340, thereby sealing the first end 320 of the flexible segment 300.

Similarly, the female-threaded fitting 350 is used to secure the housing 100 to the flexible segment 300. The female-threaded fitting therefore includes an internal female thread 354. The female thread 354 has substantially the same dimensions as the thread on a typical mascara handle 20. Therefore, the female-threaded fitting 350 may be secured to the housing 100, thereby sealing the second end 350 of the flexible segment 300. It is to be understood that the flexible segment 300, when coupled to the male and female threaded fittings 340, 350 is thus capable of attaching to any standard mascara housing and handle.

Figure 7:
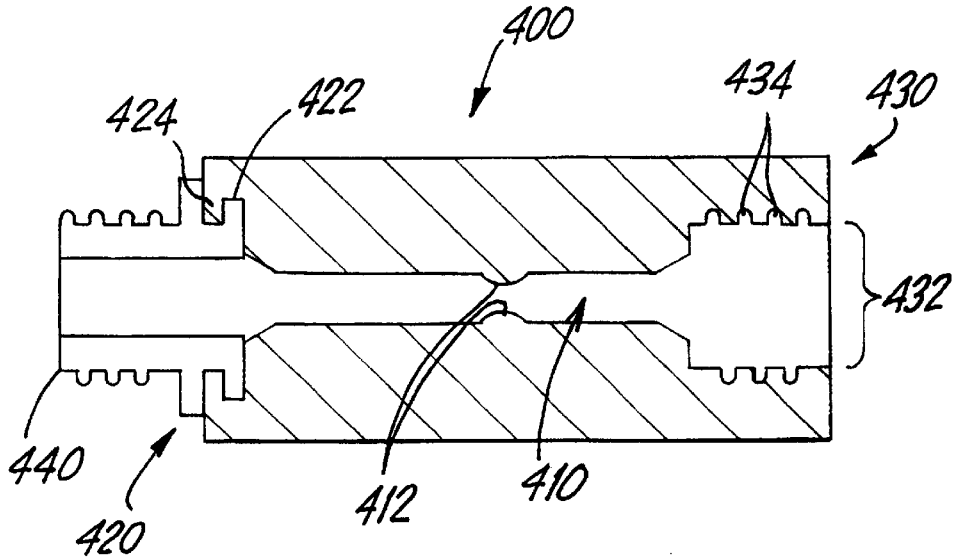
FIG. 7 depicts, in cross-section, a flexible segment according to a fourth embodiment of the present invention.

A flexible segment according to another alternative embodiment will now be described with reference to FIG. 7 and continuing reference to FIG. 1. As shown in FIG. 7, the flexible segment 400 is generally cylindrical in shape. The flexible segment 400 includes an aperture 410 passing from a first end 420, through the flexible segment 400, to a second end 430. The aperture 410 includes a projection or ridge 412 that extends around the circumference of the aperture 410. As can be seen in the cross-sectional view of FIG. 7, the ridge 412 provides a narrowing of the aperture 410. In operation, depressing the flexible segment 400 causes a greater narrowing of the aperture 410, thereby allowing the ridge 412 to remove excess cosmetic from the brush 50 as it is pulled from the housing 100.

As with the previously described embodiment, the first end 420 includes a recess 422 and a flange 424. Together, the recess 422 and flange 424 provide for a snap-type connection between the flexible segment 400 and a male-threaded fitting 440. This male-threaded fitting 440 is similar to that described above with reference to FIG. 6.

Unlike the previous embodiments, the flexible segment 400 includes an integrally threaded end segment 430. As can be seen, the threaded end segment 430 includes an enlarged section 432 of the aperture having a female thread 434 integral therewith. The female thread 434 is dimensioned so that the housing 100, which includes a male threaded end section (not shown), is engagable with the female thread 434 of the flexible segment 400. Thus, the flexible segment 400 can be screwed to the housing 100, thereby sealing the flexible segment 400.

It is to be understood that the flexible segments described above are merely exemplary, and other embodiments are within the scope of the present invention. For example, any combination of connection means, such as snap-type, threaded fittings, integral threads, and the like, may be used. Additionally, projections from the aperture are not limited, either in shape or number, to those shown. For example, alternate embodiments include a series of discrete, spaced-apart projections, which may be found either at random locations or in a predetermined pattern of rows, and each projection may be rounded, cone-shaped, frusto-conically shaped, cylindrically shaped. Also within the scope of the present invention are flexible segments having an aperture with a tread-like or other suitably roughened or irregularly shaped surface so as to be capable of collecting and removing excess cosmetic from the brush.

Figure 8:
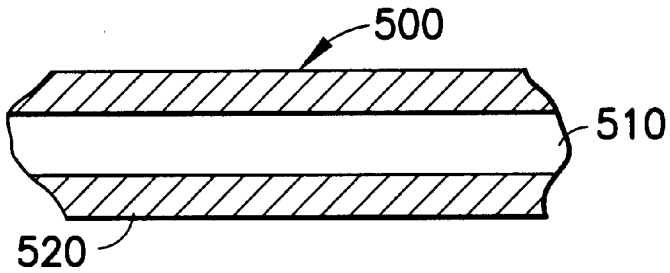
FIG. 8 depicts, in cross section, a fragment of a flexible segment according to a fifth embodiment of the present invention.
Figure 9:
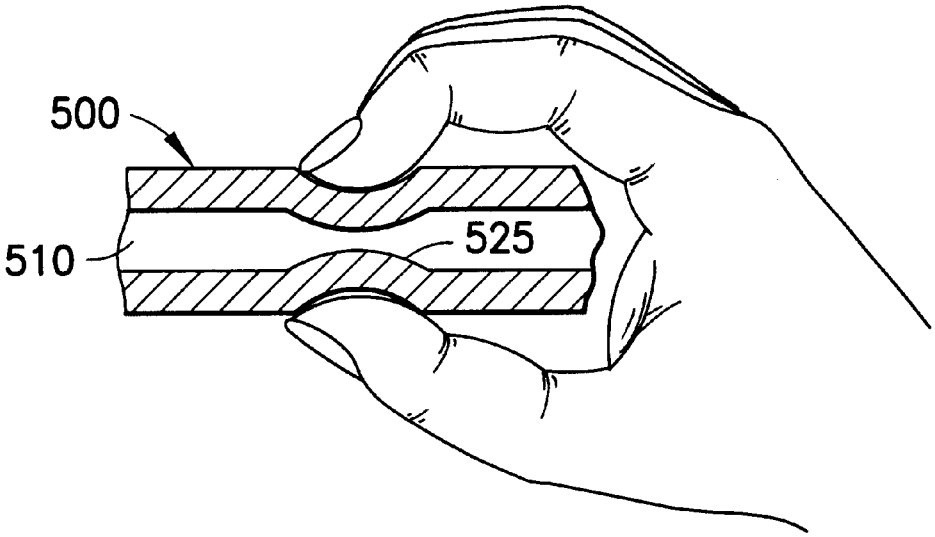
FIG. 9 depicts the embodiment of FIG. 8 having finger pressure applied to the outer surface of the flexible segment, whereupon the wall of the flexible segment is deformed to form a projection extending inwardly of an aperture.

Referring now more particularly to FIGS. 8–9 in yet another embodiment of the present invention, the flexible segment 500 includes a generally smooth-walled aperture 510. In such an embodiment, the wall 520 of the aperture 510 contacts the brush as the brush is pulled through the deformed flexible segment, as shown in FIG. 9. Consequently, the aperture removes the excess cosmetic as the flexible segment is depressed. In a sense, then, upon being flexed inwardly the wall of the aperture itself becomes a projection as shown at 525 in FIG. 9. capable of removing excess cosmetic from the applicator brush.

It is to be understood that while the aforementioned description of the preferred embodiments of the present invention is directed to a mascara brush, the structure and method of the present invention is not limited to use in a mascara application system and may be used to remove excess amounts of appliques, other than mascara, on other types of applicators.

Although several embodiments of the preferred present invention have been shown and described, the present invention is not to be limited to the aforementioned detailed description of the preferred embodiments of the present invention. Rather, the present invention is to be defined only by the scope of the appended claims.

What is claimed is:

1. A device for removing excess amounts of applique from an applicator, the device comprising:

a flexible segment having a first end, a second end, and an aperture passing therethrough from said first end to said second end, said aperture having a wall dimensioned to receive said applicator, said flexible segment having an exposed outer surface which is adapted to be grasped directly between the user's fingers and also is adapted to engage said applicator upon applying finger pressure thereto so as to manually squeeze said segment and thereby remove excess applique therefrom;

a first threaded fitting connected to said first end of said flexible segment;

a second threaded fitting connected to said second end of said flexible segment;

a housing connected to said second threaded fitting, said housing including a hollow container for storing applique; and a handle adapted to be connected to the applicator, said handle including a threaded section for engagement with said first threaded fitting.

2. The device of claim 1 wherein said applique is mascara and said applicator includes a brush.

3. The device of claim 2, wherein said brush contains a plurality of brush segments, including a first portion having graduated spiraled bristles, a second portion having graduated bristles which are larger and less-spiraled than the bristles of said first portion, and a third portion having non-spiraled bristles which are larger than the bristles of said first and second portions, said non-spiraled bristles being of the same length.

4. The device of claim 2, wherein said housing includes a flat surface portion disposed at one end of said housing, said flat surface portion having a shape to prevent rolling of the device upon placement of the device on a flat surface.

5. The device of claim 1, wherein said flexible segment includes at least one projection extending inwardly from said aperture wall and further is deformable from an undeformed state to a plurality of deformed states upon application of manual force by a user, wherein in said undeformed state said flexible segment and said at least one projection form a space therethrough, said space being larger than the width of the applicator.

6. The device of claim 1, wherein said flexible segment is deformable over a continuously variable range from (a) an undeformed state to (b) a state which prevents removal and insertion of the applicator through said aperture.

7. A mascara applicator system, comprising:

brash means for applying mascara;

means for containing a supply of mascara and at least a portion of said brush means;

continuously variable interference means for removing a user—selectable amount of excess mascara from said brush means upon removal of said brush means from said mascara supply means;

said continuously viable interference means includes an open-ended passageway and an exposed outer surface portion intermediate the ends of said passageway;

said continuously variable interference mean is fixedly mounted to said mascara container means at one end of said passageway and is removably fixedly mounted to a brush handle means at the other end of said passageway;

whereby upon removal of said brush handle means from said continuously variable interference means said brush means is withdrawn from said mascara container means through said passageway in said continuously variable interference means; and said continuously variable interferce means is adapted to be squeezed and manipulated by applying finger pressure directly against said intermediate surface portion so as to engage said brush means as said brush means passes through said passageway to thereby wipe the desired amount of excess mascara from said brush means.

8. The mascara applicator system of claim 7, wherein said continuously variable means further includes projection means for removing excess mascara from said brush means.

9. The mascara applicator system of claim 8, wherein said projection means for removing excess mascara comprises a smooth-walled aperture capable of being manually deformed to thereby form an inwardly projecting surface portion.

10. The mascara applicator of claim, 8 wherein said projection means for removing excess mascara includes an aperture wall containing at least one projection member.

11. The mascara applicator system of claim 8 wherein said projection means for removing excess mascara includes an aperture wall having a roughened surface portion.

12. A method of removing an excess amount of applique from an applicator comprising the steps of:

storing a quantity of applique in a housing member, said housing member having an open end;

mounting an open-ended flexible-walled deformable structure to said open end of said housing member, said open-ended, flexible-walled deformable structure having a passageway therethrough communicating with the ends thereof, said passageway adapted to receive said applicator therethrough substantially without interference when said deformable structure is in its undeformed state;

inserting said applicator through said passageway in said deformable structure until said applicator is immersed in said applique;

withdrawing said applicator from said applique through said passageway in said deformable structure; and simultaneously applying finger pressure directly against said deformable structure so as to constrict and engage the inner surface of said passageway with said applicator as said applicator is withdrawn through said passageway to thereby remove excess applique from said applicator.

13. The method of claim 12, further including the step of cleaning applique from said applicator, said step comprising passing said applicator back and forth through said passageway in said deformable structure while simultaneously applying continuous finger pressure directly against said deformable structure to thereby continuously engage the inner surface of said passageway with said applicator.

14. The method of claim 12, further including the step of fixedly mounting said deformable structure to said open end of said housing member.

15. The method of claim 14, farther including the step of removably fixedly mounting said applicator to said deformable structure when said applicator is immersed in said applique.

16. A method of removing an excess amount of applique from an applicator, comprising:

providing a flexible-walled deformable structure having a longitudinal axis and an inner surface defining a generally tubular passageway; and applying finger pressure directly against the outer surface of said deformable structure so as to constrict said generally tubular passageway; and pulling said applicator through said constricted generally tubular passageway to thereby forcefully engage said applicator with a longitudinal length of said inner surface thereof to remove an amount of applique from said applicator.

17. The method of claim 16, wherein said deformable structure includes at least one projection extending inwardly from said inner surface along said longitudinal length, and wherein said step of pulling includes engaging said applicator with said at least one projection.

18. The method of claim 16 further comprising:

releasing said finger pressure from said deformable structure, and thereafter pushing said applicator through said generally tubular passageway so that said applicator passes through said deformable structure without forceful engagement with the inner surface of said generally tubular passageway.

19. The method of claim 16 further comprising:

pushing said applicator through said deformable structure while maintaining said finger pressure directly against the outer surface thereof, to thereby forcefully engage said applicator with said inner surface of said generally tubular passageway during both pushing and pulling of said applicator through said deformable structure.

20. A device for removing excess amounts of applique from an applicator, comprising:

a flexible-walled structure having art end, a second end, and an aperture passing therethrough from said first end to said second end, said aperture having a flexible-walled deformable segment adapted to be manually squeezed by applying finger pressure directly against said deformable segment intermediate said fist and second ends, said deformable segment adapted to engage the applicator when drawn through the aperture while maintained said finger pressure thereagainst and thereby remove excess applique therefrom.

21. The device of claim 20 wherein said flexible segment is substantially spherical in shape.

22. The device of claim 20 wherein the inner surface of said aperture wall includes a roughened surface area.

23. The device of claim 20 wherein said flexible segment includes at least one projection extending inwardly from said aperture wall.

24. The device of claim 20, wherein said flexible segment is deformable from an undeformed state to a plurality of deformed states upon application of finger pressure by a user, wherein in said undeformed state said flexible segment and said at least one projection form a space therethrough, said space being larger than the width of the applicator.

25. The device of claim 23 wherein said at least one projection includes bristles.

26. The device of claim 20 further comprising:

a housing connected to said second end, said housing including a hollow container for storing applique; and a handle adapted to be connected to the applicator, said handle including a threaded section for engagement with said first end.

27. The device of claim 20, wherein said flexible segment is deformable over a continuously variable range from (a) an undeformed state to (b) a state which prevents removal and insertion of the applicator through said aperture.

* * * * *